United States Patent [19]

Milek

[11] 4,067,478

[45] Jan. 10, 1978

[54] CEMENT BATCHER

[76] Inventor: Robert C. Milek, 5502 N. 50 Ave., Omaha, Nebr. 68104

[21] Appl. No.: 695,497

[22] Filed: June 11, 1976

[51] Int. Cl.[2] ..... B67D 5/12

[52] U.S. Cl. .....222/56; 222/413

[58] Field of Search ..... 222/77, 413, 254, 142, 222/263, 491, 412, 176, 177, 178, 56; 177/105, 106, 107, 108

[56] References Cited

U.S. PATENT DOCUMENTS

| | | | |
|---|---|---|---|
| 2,813,704 | 11/1957 | Mackissic | 222/176 UX |
| 3,201,005 | 8/1965 | Buhr et al. | 222/413 X |
| 3,322,429 | 5/1967 | Cervelli | 222/178 X |
| 3,415,424 | 12/1968 | Crossley | 222/412 X |
| 3,973,758 | 8/1976 | Nyitray et al. | 222/142 X |

*Primary Examiner*—Stanley H. Tollberg
*Attorney, Agent, or Firm*—Henderson, Strom & Sturm

[57] ABSTRACT

A cement batcher for use with a concrete plant and having a suspended, elongated, low profile, hopper secured to an inclined arcuate trough, a helical auger operably disposed in the trough for moving cement from the lower inlet end to the upper discharge end of the hopper, a discharge tube secured to the upper end of the trough for discharging the cement from the batcher, a valve in the discharge tube to control the flow, and a plurality of holding baffles mounted transversely of the tube in the hopper to prevent the excessive free flow of the cement to the lower end of the hopper.

10 Claims, 5 Drawing Figures

CEMENT BATCHER

BACKGROUND OF THE INVENTION

Concrete batch plants, either portable or stationary, include an aggregate bin, an aggregate batcher, an aggregate conveyer, a cement bin, cement feeder, and a cement batcher (weigh hopper). The cement and aggregate are stored in their respective bins, conveyed therefrom to batchers which are generally supported by a conventional suspension hopper scale; and then conveyed from their respective batchers to a mixer, either by gravity or by mechanical means.

In most conventional portable plants, it is customary to position the cement batcher directly above the mixer in order to permit gravity discharge of the dry cement from the batcher to the mixer. Generally large quantities of cement are required, therefore, the batcher is usually quite large and extends a considerable distance into the air. This is particularly the case when the mixer is the truck which mixes and transports the concrete to the site of use. It is thus obvious that a large structure is required to support the batcher and this type of design negates the ready portability of the plant. It has further been found that the location of the batcher above the mixer requires long screw feeders for conveying the cement from the bin to the batcher and a complicated scale system from which the batcher is suspended.

SUMMARY OF THE INVENTION

This invention relates to a cement batcher which is used in combination with aggregate and cement bins, conveyers and feeders, scales, and an aggregate batcher to provide either a portable or a stationary concrete batch plant. The cement batcher comprises an elongated, low profile hopper suspended from a weigh scale and secured to an inclined arcuate trough, a helical auger operably disposed in the trough and a plurality of holding baffles mounted transversely of the tube in the hopper to prevent excessive flow of the cement to the lower end of the hopper.

It is an object of this invention to provide an improved cement batcher for a concrete batch plant.

Another object of this invention is to provide a cement batcher which is low in profile to substantially reduce its supporting structure, and which utilizes a helical auger and a holding baffle system to prevent packing and bridging of the cement by, in combination with gravity, continuously circulating the cement in the batcher.

Yet another object of this invention is the provision of a cement batcher, in combination with a concrete batch plant, which does not require a complicated scale system.

A further object of this invention is the provision of a cement batcher that is adapted for use with a portable concrete batch plant and which does not require disassembly, detachment from, or pivoting related to the rest of the plant for transport position.

Yet a further object of this invention is to provide a cement batcher which is economical of manufacture, simple and durable of construction and extremely effective in use whether secured to a portable or a stationary concrete batch plant.

BRIEF DESCRIPTION OF THE DRAWINGS

In the drawings, as hereinafter described, a preferred embodiment of the invention is illustrated; however, various modifications can be made thereto without departing from the true spirit and scope of the invention.

DESCRIPTION OF THE PREFERRED EMBODIMENT

Figure 1:
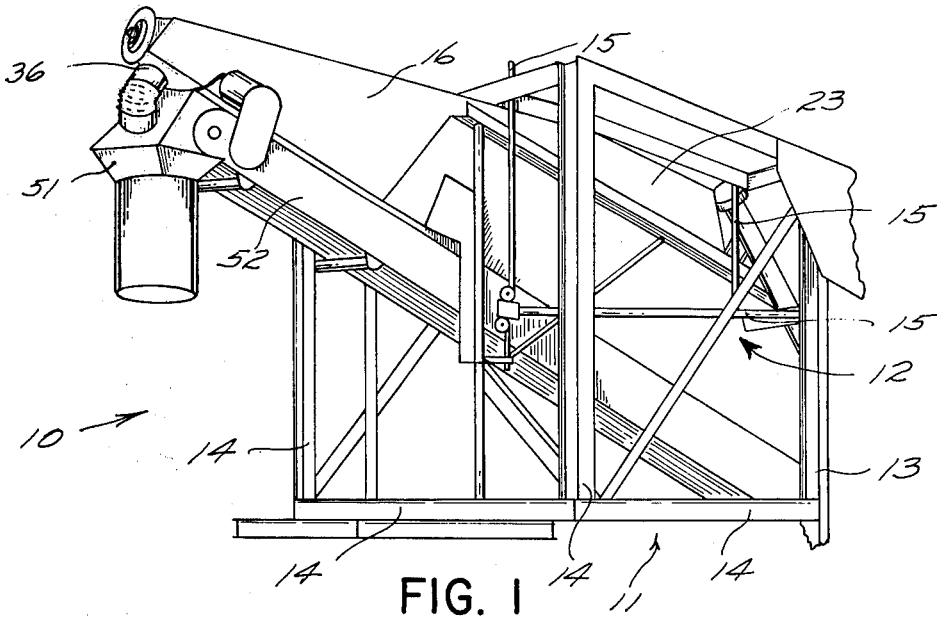
FIG. 1 is a perspective view of the cement batcher of this invention.

The cement batcher of this invention is depicted generally at 10 in FIG. 1. The batcher includes a supporting structure 11 and a scale 12. Generally the batcher structure 11 is part of an overall structure 13 of a concrete batch plant only partially shown, either portable and mounted on wheels or stationary. The structure 11 includes a plurality of vertical and horizontal members 14 interconnected together for supporting the beams 15 of the scale 12. Suspended from the beams 15 is the batcher 10.

Figure 2:
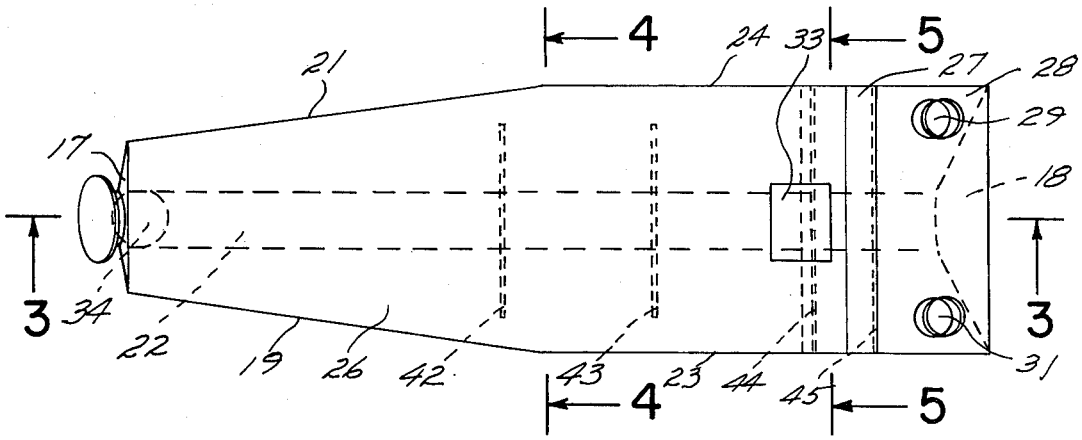
FIG. 2 is a partial top plan view thereof.
Figure 4:
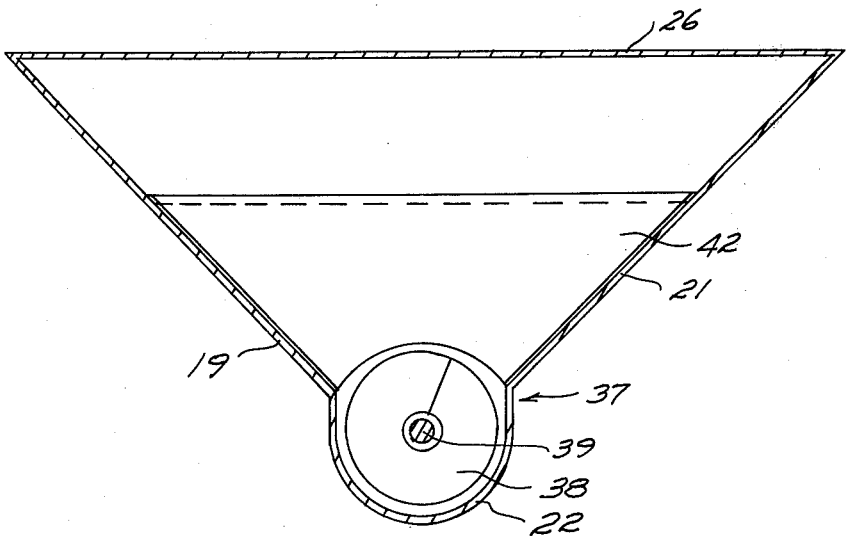
FIG. 4 is a sectional view taken along the lines 4—4 in FIG. 2.

Referring to FIGS. 2 and 4, the batcher includes a hopper 16 adapted to receive cement or the like. The hopper 16 includes an inclined forward wall 17, an inclined rear wall 18 spaced from and generally parallel to the forward wall, and a pair of generally upwardly extending angularly inclined side walls 19 and 21 disposed between and secured at their ends to the forward wall 17 and rear wall 18. The planes of the side walls are perpendicular to the planes of the forward and rear walls. The bottom longitudinal edges of the side walls 19 and 21 are spaced apart and the upper longitudinal edges diverge therefrom. Secured between the bottom longitudinal edges of the side walls 19 and 21 is a trough 22 which is U-shaped in transverse cross section with the free ends thereof secured to the side walls. Under use conditions the trough is inclined from the horizontal, between 10 and 30 degrees, and preferably at 19 degrees for purposes hereinafter defined.

Approximately the forward half of the side walls (FIGS. 2 and 3) are cut off to provide, in side elevational view (FIG. 3), a frusto-triangular shape. Rearwardly of the cut off section, triangularly shaped side sheets 23 and 24 are vertically mounted and welded along their bottom edges to the upper edges of the side walls 19 and 21 with the side sheets terminating short of the rear wall. Mounted over the side walls 19 and 21 and the side sheets 23 and 24 is a roof 26 and an inclined back sheet 27. A rear roof sheet 28 is connected between the back sheet 27 and the rear wall 18. Formed in the rear roof sheet are spaced openings 29 and 31 and in the roof a hatch opening 32 which is covered by a removable hatch 33. Proximate the forward end of the trough 22, a discharge opening 34 is formed and a vertically depending open ended stub pipe section 36 is welded thereover. Rotatably mounted in the trough 22 is a helical auger 37 wherein the flighting 38 terminates short of the forward end of the shaft 39 thereof. An auger drive 40 is operably connected to the auger for rotating same. One paddle 41 is secured to the forward end of the shaft and it projects radially thereof.

Figure 3:
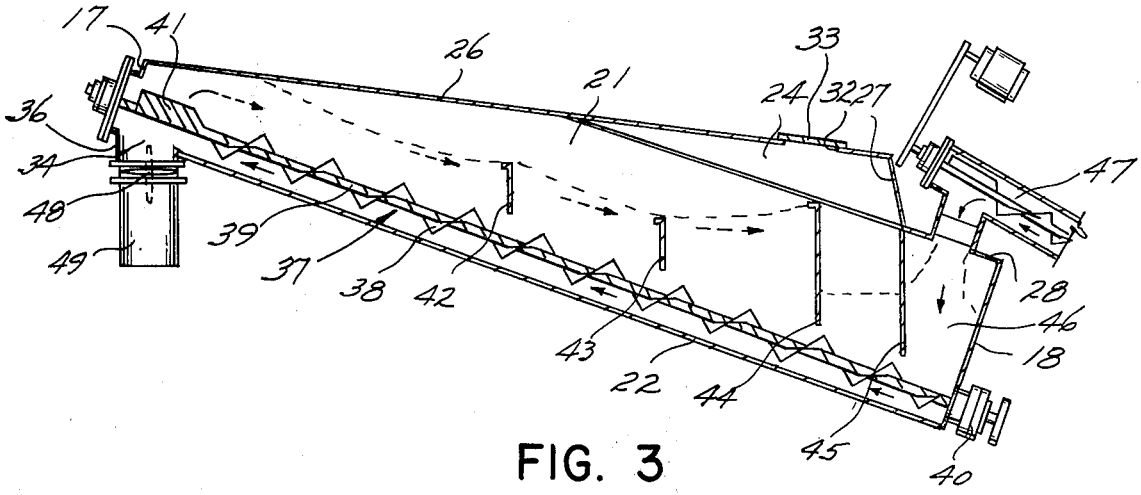
FIG. 3 is a sectional view taken along the lines 3—3 in FIG. 2.
Figure 5:
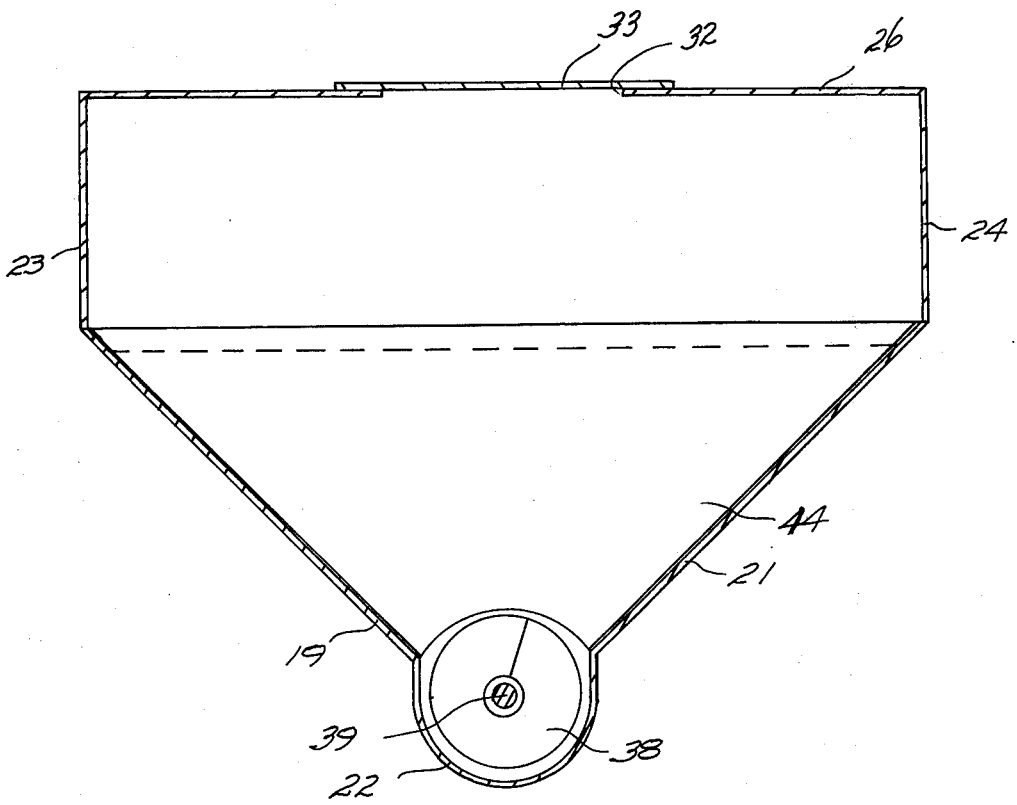
FIG. 5 is a sectional view taken along the lines 5—5 in FIG. 2.

Secured between the side walls are four transversely disposed, spaced, vertical bulkheads 42–45 (FIGS. 2 and 3). The three forward baffles 42–44 each have a flange projecting forwardly of the upward edge thereof to strengthen the baffle, each has an arcuate cut out formed in the bottom edge thereof to receive the upper part of the auger, and each is secured along its side walls to the side walls 19 and 21. The first two baffles 42 and 43 (FIGS. 3 and 4) project upwardly from the trough approximately one half the distance to the roof while the third and fourth baffles 44 and 45 (FIGS. 3 and 5) project to the top edge of the side walls. The fourth baffle 45 is secured along its top edge to the rear roof sheet 28 and thus forms a filling compartment 46 defined by the fourth baffle 45, the rear wall 18, the rear roof sheet 28 and the trough 22.

A pair of cement screw feeders 47 (only one shown in FIG. 3) are provided to convey cement from a cement bin (not shown) through the openings 29 and 31 into the filling compartment 46.

Secured to the stub pipe 36 (FIG. 3) is a butterfly valve 48 and connected to the valve 48 and depending therefrom is a discharge pipe 49. The discharge pipe 49 discharges into a combined outlet unit 51. Disposed below the trough 22 and secured to the overall structure 13 is an aggregate conveyor 52 which delivers aggregate from an aggregate batcher (not shown) to the outlet unit 51 for immediate delivery to the mixer.

In operation a fill cycle is accomplished by deposited cement in the filler compartment 46 and activating auger 37 to cause the flighting to carry the cement forward in the trough 22 to the paddle 41. As the hopper is being filled with the butterfly valve 48 being closed, the paddle throws the cement conveyed to it in an upward direction (see arrows in FIG. 3). Gravity causes the cement to fall toward the first baffle 42. A nineteen degrees inclination has been found to be a desirable angle to permit the cement which is of a semi-fluid nature to flow rearwardly. When cement fills the area between the paddle 41 and the first baffle 42, it then flows over the first bulkhead 42 and fills the area between the first two baffles 42 and 43. Upon filling the above two areas, additional cement will flow over the second baffle and then over the third baffle. The baffles are primarily provided to distribute the cement through the hopper 16 and to prevent excessive free flow of the cement against the hopper inlet but also to distribute the weight of the cement throughout the hopper.

When a predetermined weight cement is in the batcher, the screw feeders 47 and auger 37 are stopped. To transfer the cement to the mixer, the butterfly valve is opened, the auger 37 started and the cement is conveyed toward the forward wall 17 where the paddle 41 directs it into the stub pipe section 36. The discharge or unloading process continues until the hopper is empty and the scale balance returns to a zero balance at which time the fill cycle may be repeated.

I claim:

1. A cement batcher for selectively receiving, holdig, and delivering a predetermined amount of cement to a mixer, the batcher comprising:

inclined elongated hopper means having an inlet means at the lower end thereof and an outlet means at the upper end thereof;

auger means disposed longitudinally in said hopper means for moving cement from said inlet means to said outlet means;

valve means disposed in said outlet means to control the flow of cement therethrough; and a first vertical baffle disposed transversely in said hopper means above said auger to partially restrict the flow of cement from said hopper upper end to said hopper lower end when said valve restricts the flow of cement from said outlet means.

2. A cement batcher as defined in claim 1 including a second vertical baffle disposed transversely in said hopper means above said auger proximate said hopper inlet means to provide a filling compartment therein.

3. A cement batcher as defined in claim 2 and said hopper means has an inclined arcuate trough forming the bottom thereof, upwardly and outwardly inclined side walls secured to said trough, and spaced forward and rear walls secured to said trough and side walls to define a hopper; said auger disposed in said trough and said baffles having arcuate cut outs formed in the bottom edges thereof which are disposed proximate said auger means; said first baffle extending generally upwardly only a portion of the height of the side walls thereby permitting cement to flow thereover by gravity; and said second baffle means extending generally upwardly to the top of said side walls for forming a filling compartment between said second baffle and said rear wall.

4. A cement batcher as defined in claim 3 including at least a third baffle which is substantially identical to said first baffle and which is spaced from said first baffle.

5. A cement batcher as defined in claim 4 and said outlet means includes an opening formed in said trough proximate said hopper upper end and an open ended pipe stub secured to said trough over said opening and depending therefrom, and said valve means includes a butterfly valve disposed over the lower end of said pipe stub which is operable to permit the flow of cement through said pipe stub.

6. A cement batcher as defined in claim 5 and said hopper means includes a roof secured to said side walls and said forward wall, and said inlet means includes a rear roof sheet secured to said side walls and said rear wall, said rear roof sheet having at least one opening formed therein to permit cement to be deposited into said filling compartment.

7. A cement batcher as defined in claim 6 and said auger means includes a shaft extending from said rear wall to said forward wall and disposed in said trough, helical flighting secured to the periphery of said shaft extending from said rear wall to proximate said forward wall, and a paddle secured to said shaft forwardly of said flighting and extending radially from said shaft to throw cement outwardly of said shaft.

8. A cement batcher as defined in claim 7 and including a structure and a weigh scale secured to said structure with said hopper means suspended from said weigh scale.

9. A cement batcher as defined in claim 8 wherein said trough and hopper are inclined from the horizontal at an angle between 10° and 30°.

10. A cement batcher as defined in claim 8 wherein said trough and hopper are inclined at 19° from the horizontal.

* * * * *